US011720137B2

(12) United States Patent
Ikeuchi

(10) Patent No.: US 11,720,137 B2
(45) Date of Patent: Aug. 8, 2023

(54) BANDGAP TYPE REFERENCE VOLTAGE GENERATION CIRCUIT

(71) Applicants: KABUSHIKI KAISHA TOSHIBA, Tokyo (JP); TOSHIBA ELECTRONIC DEVICES & STORAGE CORPORATION, Tokyo (JP)

(72) Inventor: Katsuyuki Ikeuchi, Yokohama Kanagawa (JP)

(73) Assignees: Kabushiki Kaisha Toshiba, Tokyo (JP); Toshiba Electronic Devices & Storage Corporation, Tokyo (JP)

( * ) Notice: Subject to any disclaimer, the term of this patent is extended or adjusted under 35 U.S.C. 154(b) by 69 days.

(21) Appl. No.: 17/393,758

(22) Filed: Aug. 4, 2021

(65) Prior Publication Data

US 2022/0291707 A1 Sep. 15, 2022

(30) Foreign Application Priority Data

Mar. 12, 2021 (JP) ..... 2021-040181

(51) Int. Cl.
*G05F 3/30* (2006.01)

(52) U.S. Cl.
CPC ..... *G05F 3/30* (2013.01)

(58) Field of Classification Search
CPC ..... G05F 3/30
See application file for complete search history.

(56) References Cited

U.S. PATENT DOCUMENTS 6,121,824 A * 9/2000 Opris ..... G05F 3/30 327/539
6,462,526 B1 * 10/2002 Tanase ..... G05F 3/30 327/539
2011/0187445 A1 * 8/2011 Sicard ..... G05F 3/30 327/539

FOREIGN PATENT DOCUMENTS

JP 6136480 B2 5/2017

* cited by examiner

*Primary Examiner* — Fred E Finch, III
(74) *Attorney, Agent, or Firm* — Allen & Overy LLP

(57) ABSTRACT

According to an embodiment, a bandgap type reference voltage generation circuit includes a first node that is connected to an output terminal, second and third nodes that are connected to current sources, a fourth node, first and second bipolar junction transistors with bases that are connected to the first node, a third bipolar junction transistor that is provided with an emitter-collector path that is connected between the second node and the fourth node and amplifies an output current of the first bipolar junction transistor, and a fourth bipolar junction transistor that is provided with an emitter-collector path that is connected between the third node and the fourth node and amplifies an output current of the second bipolar junction transistor.

17 Claims, 6 Drawing Sheets

PRIOR ART

BANDGAP TYPE REFERENCE VOLTAGE GENERATION CIRCUIT

CROSS-REFERENCE TO RELATED APPLICATIONS

The present application claims the benefit of priority to Japanese Patent Application No. 2021-040181 filed on Mar. 12, 2021, the entire contents of which Japanese Patent Application are incorporated by reference in the present application.

FIELD

The present embodiment generally relates to a bandgap type reference voltage generation circuit.

BACKGROUND

A bandgap type reference voltage generation circuit that utilizes a bandgap voltage (that is a specific voltage of a semiconductor, and in a case of silicon, is about 1.2 V) has been known conventionally. A conventional bandgap type reference voltage generation circuit will be explained by using FIG. 6.

A bandgap type reference voltage generation circuit as illustrated in FIG. 6 has NPN type bipolar junction transistors 50 and 60 that compose a Brokaw cell and resistors R3 and R4. Hereinafter, a bipolar junction transistor may be denoted by a BJT. An emitter of the NPN type BJT 50 is connected to a connection point N01 of the resistors R3, R4.

A collector of the NPN type BJT 50 is connected to a constant current source 30. The constant current source 30 supplies a current I1 thereto. A collector of the NPN type BJT 60 is connected to a constant current source 40. The constant current source 40 supplies a current I2 thereto. A current I1 and a current I2 are set at identical values. The resistor R4 is a resistor that adjusts a temperature coefficient of a reference voltage $V_{REF}$ where a temperature coefficient of a reference voltage $V_{REF}$ is adjusted by setting of a ratio of a resistance value thereof to that of the resistor R3.

A ratio of an emitter area of the NPN type BJT 50 to that of the NPN type BJT 60 is set at 1 to N. N is any positive number that is greater than 1. A resistance RB1 indicates a base resistance of the NPN type BJT 50. A resistance RB2 indicates a base resistance of the NPN type BJT 60. A ratio of a resistance value of the resistance RB1 to that of the resistance RB2 is 1 to (1/N) depending on a ratio N of emitter areas of the NPN type BJTS 50 and 60. That is, as a base resistance of the NPN type BJT 50 is RB, a base resistance of the NPN type BJT 60 is RB/N. A difference voltage $\Delta V_{BE}$ between base-emitter voltages of the NPN type BJTS 50 and 60 is caused between both ends of the resistor R3. A difference voltage $\Delta V_{BE}$ is represented by $(kT/q)\cdot \ln N$ by using a Boltzmann constant k, an absolute temperature T, a charge q of an electron, and a ratio N of emitter areas of the NPN type BJTS 50 and 60.

As currents I1 and I2 are set at identical values, that is, collector currents of the NPN type BJTS 50 and 60 are set at identical values $I_c$, a base-emitter voltage $V_{BE1real}$ of the NPN type BJT 50 and a base-emitter voltage $V_{BE2real}$ of the NPN type BJT 60 are represented by formula (1) and formula (2).

$$V_{BE1real}=V_{BE1ideal}+I_C\cdot RB/\beta \quad (1)$$

$$V_{BE2real}=V_{BE2ideal}+I_C\cdot RB/(N\cdot\beta) \quad (2)$$

Herein, β indicates current gains of the NPN type BJTS 50 and 60 where both of current gains of the NPN type BJTS 50 and 60 are assumed to be identical. $V_{BE1ideal}$ is a base-emitter voltage of the NPN type BJT 50 at a time when a current gain is infinite, and similarly, $V_{BE2ideal}$ is a base-emitter voltage of the NPN type BJT 60 at a time when a current gain is infinite. Additionally, a base-emitter voltage at a time when a current gain is infinite is represented by $(kT/q)\cdot \ln(I_C/I_S)$ by using a Boltzmann constant k, an absolute temperature T, a charge q of an electron, a collector current $I_C$, and a saturation current $I_S$.

A voltage drop $V_{R4real}$ that is caused at the resistor R4 is caused by a current that is a sum of collector currents and emitter currents that flow through the NPN type BJTS 50 and 60, and hence, is represented by formula (3).

$$\begin{aligned} V_{REF} &= V_{BE1real} + V_{R4real} \\ &= V_{REFideal} + \frac{1}{\beta}\cdot(RB + 2\cdot R4) \end{aligned} \quad (4)$$

Herein, R4 indicates a resistance value of the resistor R4.

A reference voltage $V_{REF}$ at a node N00 where bases of the NPN type BJT 50 and the NPN type BJT 60 are commonly connected is represented by formula (4). Additionally, a configuration that supplies a base current to the node N00 is omitted.

$$\begin{aligned} V_{R4real} &= 2\cdot I_C\cdot R4\cdot(1+1/\beta) \\ &= V_{R4ideal} + 2\cdot I_C\cdot R4/\beta \end{aligned} \quad (3)$$

Herein, $V_{REFideal}$ is $V_{BE1ideal}+2\cdot I_C\cdot R4$.

As indicated in formula (4), it is found that a voltage component that originates from a base resistance RB is present in a reference voltage $V_{REF}$.

A temperature coefficient of a base resistance RB is a positive value in a case of an Si semiconductor. Therefore, a reference voltage $V_{REF}$ includes a voltage component that has a positive temperature coefficient. Furthermore, a value of a reference voltage $V_{REF}$ varies with a variation of a base resistance RB. The inventor focuses on such a characteristic of a reference voltage $V_{REF}$ of a bandgap type reference voltage generation circuit and proposes a bandgap type reference voltage generation circuit that is capable of reducing an influence of a base resistance RB thereon.

DETAILED DESCRIPTION

According to one embodiment, a bandgap type reference voltage generation circuit includes a first node that is connected to an output terminal, a second node that is connected to a first current source, a third node that is connected to a second current source, a fourth node, a first bipolar junction transistor with a base that is connected to the first node, a second bipolar junction transistor with a base that is connected to the first node, a third bipolar junction transistor that is provided with an emitter-collector path that is connected between the second node and the fourth node and amplifies an output current of the first bipolar junction transistor, and a fourth bipolar junction transistor that is provided with an emitter-collector path that is connected between the third node and the fourth node and amplifies an output current of the second bipolar junction transistor.

Hereinafter, a bandgap type reference voltage generation circuit according to an embodiment will be explained in detail with reference to the accompanying drawings. Additionally, the present invention is not limited by these embodiments.

First Embodiment

Figure 1:
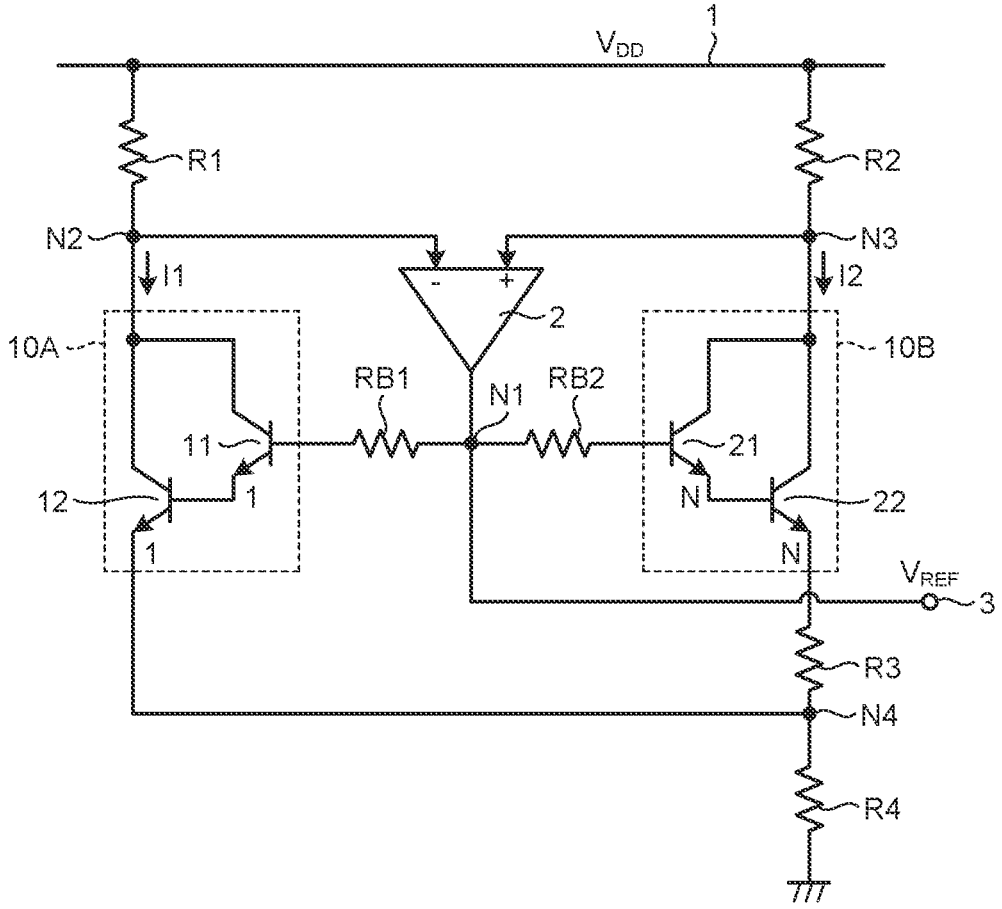
FIG. 1 is a diagram that illustrates a configuration of a bandgap type reference voltage generation circuit according to a first embodiment.

FIG. 1 is a diagram that illustrates a configuration of a bandgap type reference voltage generation circuit according to a first embodiment. The present embodiment has nodes N1 to N4. The node N1 is connected to an output terminal 3. The node N2 is connected to a power source line 1 where a power source voltage $V_{DD}$ is applied, through a resistor R1. The node N3 is connected to the power source line 1 through a resistor R2. The resistors R1, R2 compose current sources.

The present embodiment has a Darlington pair 10A. The Darlington pair 10A has an NPN type BJT 11 with a base that is connected to the node N1 and an NPN type BJT 12. Collectors of the NPN type BJTS 11 and 12 are connected to the node N2. An emitter-collector path of the NPN type BJT 12 is connected between the node N2 and the node N4. A base of the NPN type BJT 12 is connected to an emitter of the NPN type BJT 11 and the NPN type BJT 12 amplifies an output current of the NPN type BJT 11. A base resistance of the NPN type BJT 12 is omitted conveniently.

The present embodiment has a Darlington pair 10B. The Darlington pair 10B has an NPN type BJT 21 with a base that is connected to the node N1 and an NPN type BJT 22. Collectors of the NPN type BJTS 21 and 22 are connected to the node N3. An emitter of the NPN type BJT 21 is connected to the node N4 through a resistor R3. An emitter-collector path of the NPN type BJT 22 is connected between the node N3 and the node N4. A base of the NPN type BJT 22 is connected to the emitter of the NPN type BJT 21 and the NPN type BJT 22 amplifies an output current of the NPN type BJT 21. A base resistance of the NPN type BJT 22 is omitted conveniently. The NPN type BJTS 21 and 22 have emitter areas that are N times as large as those of NPN type BJTS 11 and 12, respectively.

The present embodiment has the resistor R1 that is connected between the node N2 and the power source line 1. The resistor R1 is connected between the Darlington pair 10A and the power source line 1 and composes a current source. Similarly, the resistor R2 is connected between the Darlington pair 10B and the power source line 1 and composes a current source. Resistance values of the resistor R1 and the resistor R2 are set at identical values.

The present embodiment has a differential amplifier circuit 2 that supplies an output signal that is dependent on a difference between voltage drops that are caused at the resistor R1 and the resistor R2 that compose current sources to the node N1. An inverting input terminal (−) of the differential amplifier circuit 2 is supplied with a voltage at the node N2 and a non-inverting input terminal (+) thereof is supplied with a voltage at the node N3.

The differential amplifier circuit 2 compares voltages at the nodes N2 and N3 and controls a voltage at the node N1 in such a manner that voltage drops at the resistor R1 and the resistor R2 are identical. Therefore, in a case where resistance values of the resistor R1 and the resistor R2 are set so as to be identical values, control is executed in such a manner that currents I1 and I2 that are supplied to the Darlington pairs 10A and 10B are of identical values.

The node N1 is connected to the output terminal 3. The output terminal 3 outputs a reference voltage $V_{REF}$.

In a bandgap type reference voltage generation circuit according to the present embodiment, a cell that composes a Brokowa cell has the Darlington pairs 10A, 10B. That is, it has the NPN type BJTS 12, 22 that respectively amplify output currents of the NPN type BJTS 11, 21 with bases that are connected to the node N1. Hence, as current gains of the NPN type BJTS 11, 21 are $\beta 1$ and current gains of the NPN type BJTS 12, 22 are $\beta 2$, current gains $\beta$ of the Darlington pairs 10A, 10B are $\beta 1 \cdot \beta 2 + \beta 1 + \beta 2$.

Therefore, it is possible to represent a reference voltage $V_{REF}$ by a formula where a current gain of $\beta 1 \cdot \beta 2 + \beta 1 + \beta 2$ is substituted into $\beta$ as indicated in formula (4) as already described. That is, it is possible to increase a value of a denominator of a second term as indicated in formula (4) by providing a configuration that includes the Darlington pairs 10A, 10B, so that it is possible to reduce an influence of a base resistance RB thereon. Thereby, it is possible to suppress a change of a temperature coefficient of a reference voltage $V_{REF}$ that originates from a base resistance RB and also suppress a variation of a reference voltage $V_{REF}$ that originates from a variation of a resistance value of a base resistance RB.

Figure 2:
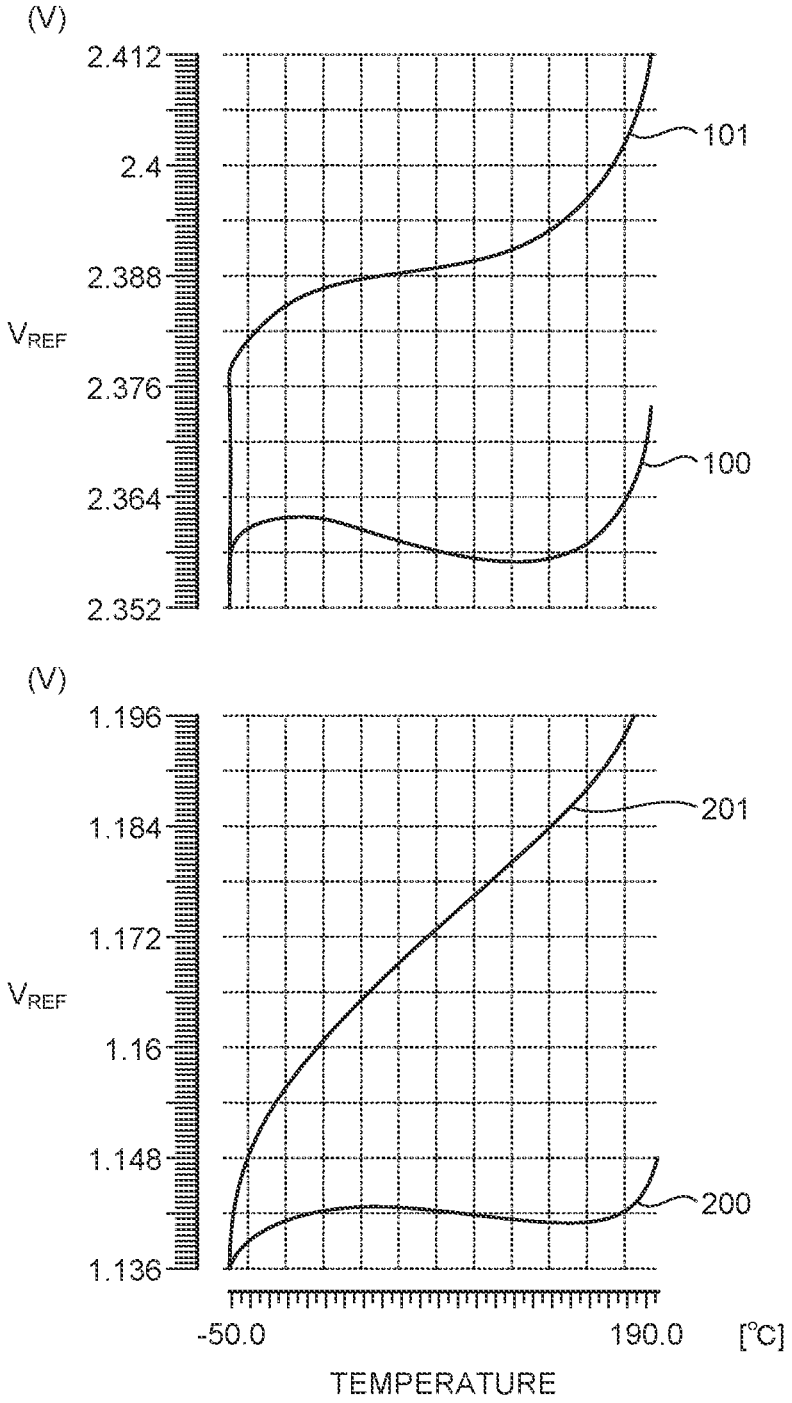
FIG. 2 is a diagram for explaining an effect of a bandgap type reference voltage generation circuit according to the first embodiment.

FIG. 2 is a diagram for explaining an effect of the first embodiment. A result of comparison with a conventional bandgap type reference voltage generation circuit is illustrated therein.

In an upper section of FIG. 2, a vertical axis represents a reference voltage $V_{REF}$ that is generated by a bandgap type reference voltage generation circuit according to the present embodiment and a horizontal axis represents a temperature. A result of a simulation in a case where a change is executed from −50° C. to 190° C. is illustrated therein. A solid line 100 indicates a result of a simulation in a case where a base resistance RB is set at 130Ω and a solid line 101 indicates a result of a simulation in a case where a base resistance RB is set at 330Ω.

Figure 6:
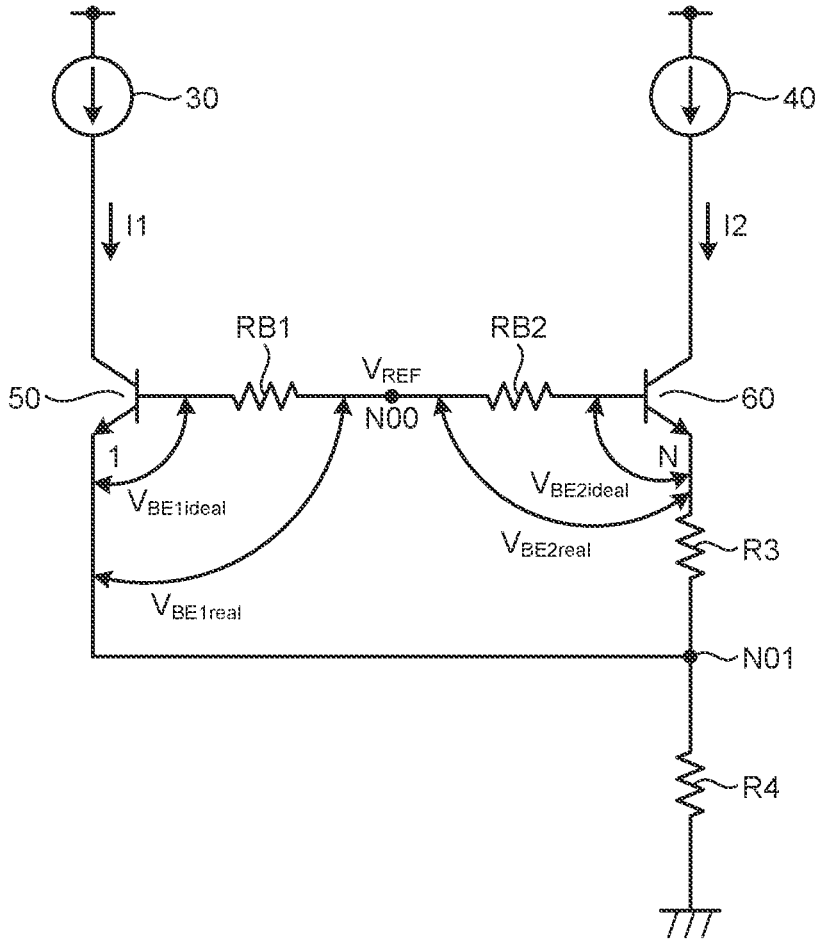
FIG. 6 is a diagram that illustrates a configuration of a conventional bandgap type reference voltage generation circuit.

A lower section thereof illustrates a reference voltage $V_{REF}$ of a bandgap type reference voltage generation circuit with a conventional configuration in FIG. 6. A result of a simulation in a case where a change is executed from −50° C. to 190° C. is similarly illustrated therein. A solid line 200 indicates a result of a simulation in a case where a base resistance RB is set at 130Ω and a solid line 201 indicates a result of a simulation in a case where a base resistance RB is set at 330Ω.

Additionally, in simulations, chip areas of the NPN type BJTS 21, 22 of the Darlington pair 10B are set to be four times as large as chip areas of the NPN type BJTS 11, 12 of the Darlington pair 10A, while, in a conventional configuration, a chip area of the NPN type BJT 60 is set to be eight times as large as that of the NPN BJT 50. That is, area ratios of a whole element are 10 (=2×4+2×1) for the present embodiment and 9 (=8+1) for a conventional configuration and bandgap type reference voltage generation circuits with substantially identical chip areas are configured so as to execute simulations.

It is found that a temperature characteristic is improved in the present embodiment as compared with that of a bandgap type reference voltage generation circuit with a conventional configuration as illustrated in the lower section. In particular, an effect of improvement is significant in a case where a base resistance RB is of a high value. Whereas a value that is provided by dividing a value that is provided by executing a first-order approximation of a temperature coefficient of a reference voltage $V_{REF}$ by a reference voltage $V_{REF}$ at 27° C. is −0.05 ppm/° C. in a simulation where a base resistance RB is set at 130Ω and 1.33 ppm/° C. in a simulation where a base resistance RB is set at 330Ω in a conventional configuration, it is −0.14 ppm/° C. in a simulation where a base resistance RB is set at 130Ω and 0.17 ppm/° C. in a simulation where a base resistance RB is set at 330Ω in the present embodiment. In the present embodiment, an influence of a base resistance RB is reduced, so that it is possible to improve a temperature characteristic of a reference voltage $V_{REF}$ and provide a stable reference voltage $V_{REF}$ where an influence of a variation of a base resistance RB is reduced.

In the present embodiment, an influence of a base resistance RB on a reference voltage $V_{REF}$ is reduced, so that it is possible to obtain a stable reference voltage $V_{REF}$ where a variation thereof in association with a temperature change is suppressed. For example, in a case where a bipolar junction transistor is produced in a CMOS process, a current gain thereof tends to be decreased. In the present embodiment, it is possible to provide a bandgap type reference voltage generation circuit that is capable of increasing a current gain thereof, so that it is possible to provide a bandgap type reference voltage generation circuit where an influence of a base resistance RB thereon is reduced even in a case where a constraint is provided by a manufacturing step or the like.

Additionally, in the present embodiment, a reference voltage $V_{REF}$ is a value of a sum of base-emitter voltages of the NPN type BJTS 11, 12 that compose the Darlington pair 10A and a voltage drop at the resistor R4. Therefore, it is preferable, for example, in a case where a reference voltage $V_{REF}$ of 2 V or higher is obtained.

Second Embodiment

Figure 3:
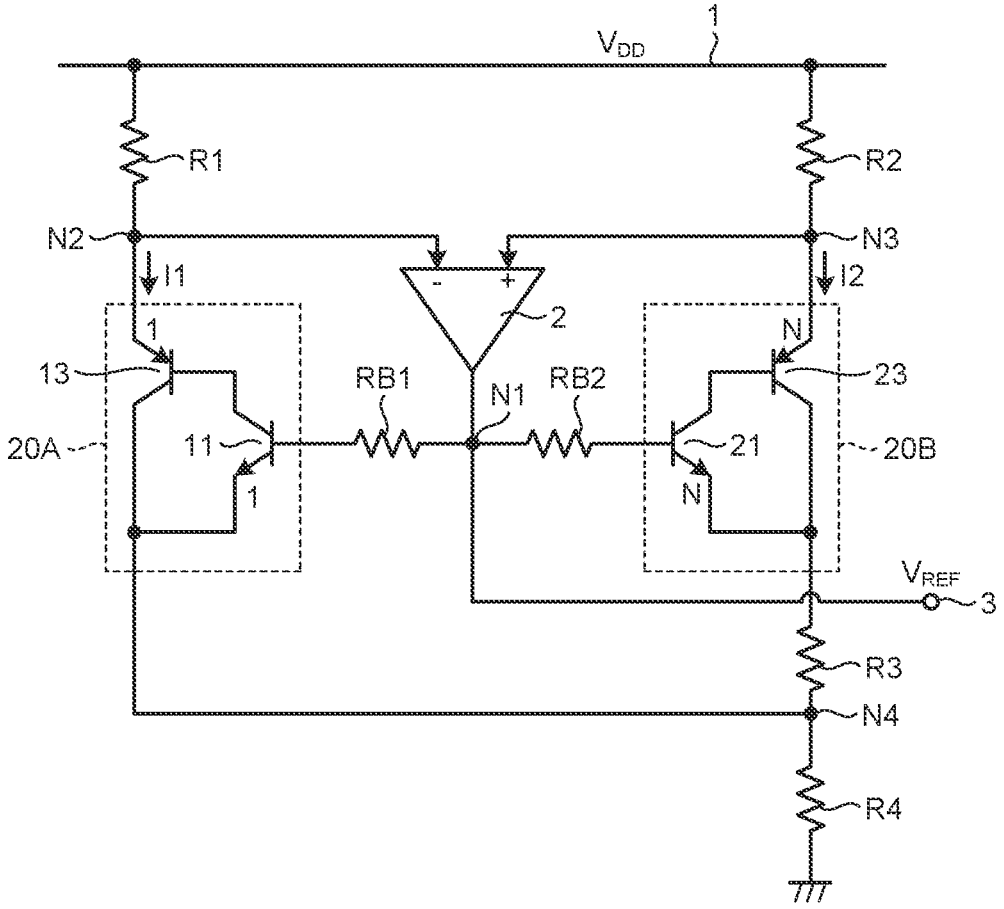
FIG. 3 is a diagram that illustrates a configuration of a bandgap type reference voltage generation circuit according to a second embodiment.

FIG. 3 is a diagram that illustrates a configuration of a bandgap type reference voltage generation circuit according to a second embodiment. A component that corresponds to that of an embodiment as already described will be provided with an identical sign so as to provide a redundant description only in case of need. Hereinafter, the same applies.

The present embodiment has inverted Darlington pairs 20A, 20B. The inverted Darlington pair 20A has an NPN type BJT 11 with a base that is connected to a node N1 and a PNP type BJT 13. An emitter of the PNP type BJT 13 is connected to a node N2. A collector of the PNP type BJT 13 and an emitter of the NPN type BJT 11 are connected to a node N4. An emitter-collector path of the PNP type BJT 13 is connected between the node N2 and the node N4. A base of the PNP type BJT 13 is connected to a collector of the NPN type BJT 11 and the PNP type BJT 13 amplifies an output current of the NPN type BJT 11. A base resistance of the PNP type BJT 13 is omitted conveniently. Additionally, an inverted Darlington pair may be called a Sziklai pair.

The inverted Darlington pair 20B has an NPN type BJT 21 with a base that is connected to the node N1 and a PNP type BJT 23. An emitter of the PNP type BJT 23 is connected to a node N3. An emitter of the NPN type BJT 21 and a collector of the PNP type BJT 23 are connected to a node N4 through a resistor R3. An emitter-collector path of the PNP type BJT 23 is connected between the node N3 and the node N4. A base of the PNP type BJT 23 is connected to a collector of the NPN type BJT 21 and the PNP type BJT 23 amplifies an output current of the NPN type BJT 21. A base resistance of the PNP type BJT 23 is omitted conveniently. The NPN type BJT 21 and the PNP type BJT 23 have emitter areas that are N times as large as those of the NPN type BJT 11 and the PNP type BJT 13, respectively.

As a current gain of the NPN type BJT 11 is β1 and a current gain of the PNP type BJT 13 is β2, a current gain of the inverted Darlington pair 20A is represented by β1·β2+β1. Similarly, as a current gain of the NPN type BJT 21 is β1 and a current gain of the PNP type BJT 23 is β2, a current gain of the inverted Darlington pair 20B is represented by β1·β2+β1. Therefore, a reference voltage $V_{REF}$ is represented by a formula where β1·β2+β1 is substituted into β in formula (4) as already described. Hence, it is possible to reduce an influence of a base resistance RB thereon, so that it is possible to improve a temperature characteristic of a reference voltage $V_{REF}$ and supply a stable reference voltage $V_{REF}$ in a broad range of a temperature zone.

In the present embodiment, a configuration that has the inverted Darlington pairs 20A, 20B is provided so as to reduce an influence of a base resistance RB thereon, so that it is possible to provide a bandgap type reference voltage generation circuit that outputs a stable reference voltage $V_{REF}$. Additionally, in the present embodiment, a reference voltage $V_{REF}$ is a value of a sum of a base-emitter voltage of the NPN type BJT 11 that composes the inverted Darlington pair 20A and a voltage drop at a resistor R4. Therefore, it is preferable, for example, in a case where 1.2 V is obtained as a reference voltage $V_{REF}$. Although a current gain β is slightly decreased as compared with that of the first embodiment that has Darlington pairs so that an effect of reducing an influence of a base resistance RB thereon is slightly decreased, it is preferable in a case where a reference voltage $V_{REF}$ that is a low voltage is obtained.

Third Embodiment

Figure 4:
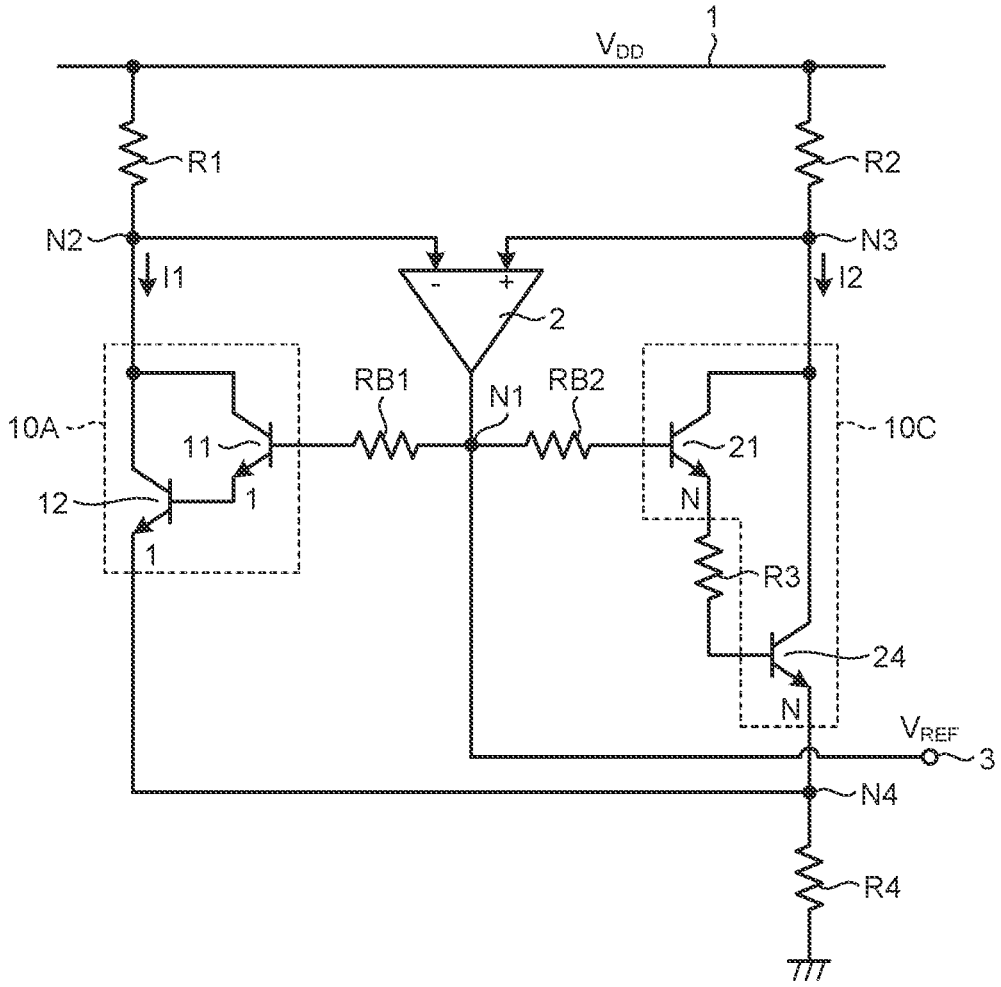
FIG. 4 is a diagram that illustrates a configuration of a bandgap type reference voltage generation circuit according to a third embodiment.

FIG. 4 is a diagram that illustrates a configuration of a bandgap type reference voltage generation circuit according to a third embodiment. The present embodiment has a Darlington pair 10A.

The present embodiment has a resistor R3 that is connected between an emitter of an NPN type BJT 21 that composes a Darlington pair 10C and a base of an NPN type BJT 24. An emitter-collector path of the NPN type BJT 24 is connected between a node N3 and a node N4. The base of the NPN type BJT 24 is connected to the emitter of the NPN type BJT 21 through the resistor R3 and the NPN type BJT 24 amplifies an output current of the NPN type BJT 21. A base resistance of the NPN type BJT 24 is omitted conveniently.

The NPN type BJTS 21 and 24 have emitter areas that are N times as large as those of NPN type BJTS 11 and 12.

In the present embodiment, the NPN type BJTS 11 and 12 compose the Darlington pair 10A where the NPN type BJT 12 amplifies an output current of the NPN type BJT 11. Furthermore, the NPN type BJTS 21 and 24 compose the Darlington pair 10C where the NPN type BJT 24 amplifies an output current of the NPN type BJT 21. Therefore, similarly to the first embodiment as already described, current gains β of the Darlington pairs 10A, 10C are $\beta1\sim\beta2+\beta1+\beta2$, so that it is possible to reduce an influence of a base resistance RB thereon. Furthermore, it is possible to adjust a temperature coefficient of a reference voltage $V_{REF}$ by adjustment of a ratio of resistance values of the resistor R3 and a resistor R4.

Fourth Embodiment

Figure 5:
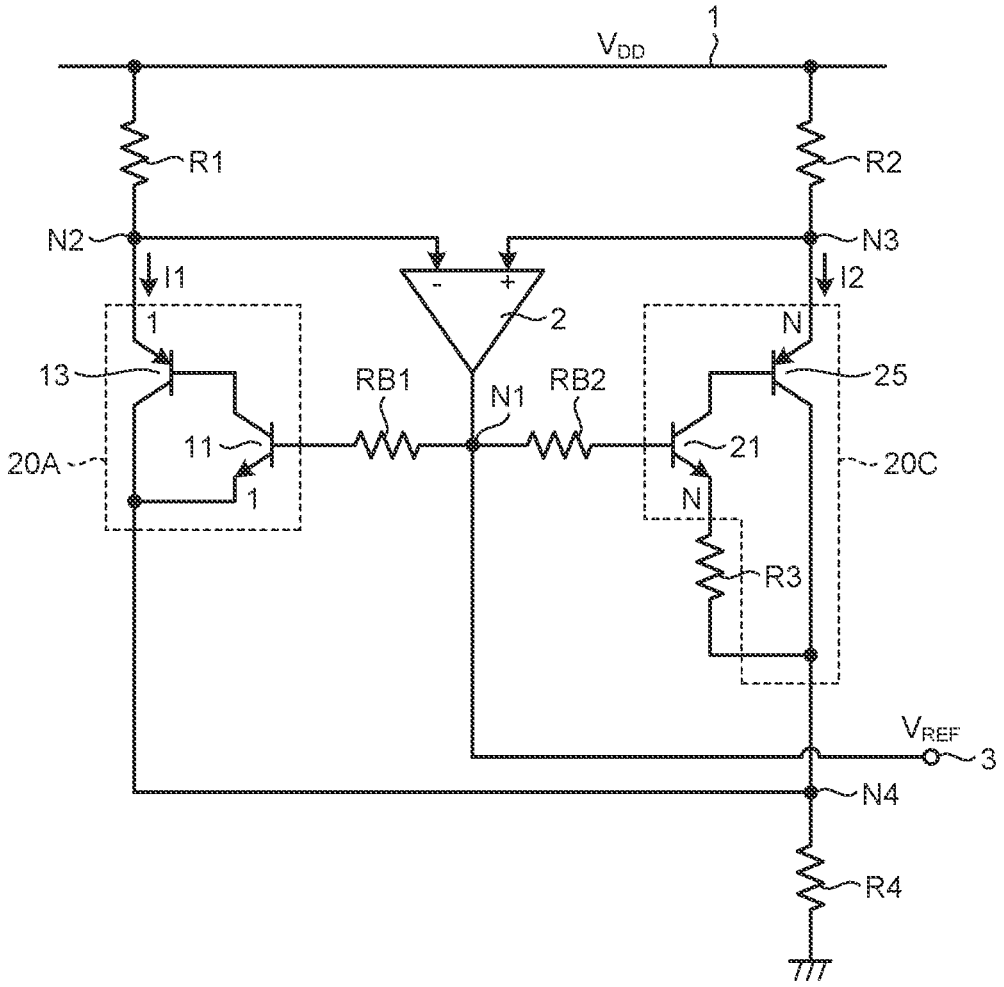
FIG. 5 is a diagram that illustrates a configuration of a bandgap type reference voltage generation circuit according to a fourth embodiment.

FIG. 5 is a diagram that illustrates a configuration of a bandgap type reference voltage generation circuit according to a fourth embodiment. The present embodiment has an inverted Darlington pair 20A.

The present embodiment has a resistor R3 that is connected between an emitter of an NPN type BJT 21 that composes an inverted Darlington pair 20C and a node N4. An emitter-collector path of a PNP type BJT 25 is connected between a node N3 and the node N4. A base of the PNP type BJT 25 is connected to a collector of the NPN type BJT 21 and the PNP type BJT 25 amplifies an output current of the NPN type BJT 21. A base resistance of the PNP type BJT 25 is omitted conveniently.

The PNP type BJT 25 and the NPN type BJT 21 have emitter areas that are N times as large as those of a PNP type BJT 13 and an NPN type BJT 11, respectively.

In the present embodiment, the NPN type BJT 11 and the PNP type BJT 13 compose the inverted Darlington pair 20A where the PNP type BJT 13 amplifies an output current of the NPN type BJT 11. Furthermore, the NPN type BJT 21 and the PNP type BJT 25 compose the inverted Darlington pair 20C where the PNP type BJT 25 amplifies an output current of the NPN type BJT 21. Therefore, similarly to the second embodiment as already described, current gains β of the inverted Darlington pairs 20A, 20C are $\beta1\cdot\beta2+\beta1$, so that it is possible to reduce an influence of a base resistance RB thereon. Furthermore, it is possible to adjust a temperature coefficient of a reference voltage $V_{REF}$ by adjustment of a ratio of resistance values of the resistor R3 and a resistor R4.

Although some embodiments of the present invention have been explained, these embodiments are presented as examples and do not intend to limit the scope of the invention. These novel embodiments are capable of being implemented in various other modes and it is possible to execute a variety of omissions, substitutions, and modifications without departing from the spirit of the invention. These embodiments and/or variations thereof are included in the scope and/or spirit of the invention and are included in the scope of the invention as recited in what is claimed and equivalents thereof.

What is claimed is:

1. A bandgap type reference voltage generation circuit, comprising:

a first node that is connected to an output terminal;

a second node that is connected to a first current source;

a third node that is connected to a second current source;

a fourth node;

a first bipolar junction transistor with a base that is connected to the first node;

a second bipolar junction transistor with a base that is connected to the first node;

a third bipolar junction transistor that is provided with an emitter-collector path that is connected between the second node and the fourth node and amplifies an output current of the first bipolar junction transistor;

a fourth bipolar junction transistor that is provided with an emitter-collector path that is connected between the third node and the fourth node and amplifies an output current of the second bipolar junction transistor;

a first resistor that composes the first current source;

a second resistor that composes the second current source;

a third resistor with one end that is connected to an emitter of the second bipolar junction transistor and another end that is connected to a base of the fourth bipolar junction transistor; and a fourth resistor with one end that is connected to the fourth node and another end that is grounded.

2. The bandgap type reference voltage generation circuit according to claim 1, wherein the first and third bipolar junction transistors compose a first Darlington pair, and the second and fourth bipolar junction transistors compose a second Darlington pair.

3. The bandgap type reference voltage generation circuit according to claim 2, wherein emitter areas of the second and fourth bipolar junction transistors are set to be N times as large as emitter areas of the first and third bipolar junction transistors, where (N is any positive number of 1 or greater.

4. The bandgap type reference voltage generation circuit according to claim 3, wherein current values of the first and second current sources are set to be identical values.

5. The bandgap type reference voltage generation circuit according to claim 1, wherein the first and third bipolar junction transistors compose a first inverted Darlington pair, and the second and fourth bipolar junction transistors compose a second inverted Darlington pair.

6. The bandgap type reference voltage generation circuit according to claim 5, wherein emitter areas of the second and fourth bipolar junction transistors are set to be N times as large as emitter areas of the first and third bipolar junction transistors, where (N is any positive number of 1 or greater.

7. The bandgap type reference voltage generation circuit according to claim 5, wherein current values of the first and second current sources are set to be identical values.

8. The bandgap type reference voltage generation circuit according to claim 1, comprising:

a differential amplifier circuit that supplies an output signal that is dependent on a difference between voltage drops that are caused at the first resistor and the second resistor to the first node.

9. The bandgap type reference voltage generation circuit according to claim 8, wherein resistance values of the first resistor and the second resistor are set to be identical values.

10. The bandgap type reference voltage generation circuit according to claim 1, comprising:

a third resistor that is connected in series with an emitter-collector path of the second bipolar junction transistor; and a fourth resistor with one end that is connected to the fourth node and the other end that is grounded.

11. A bandgap type reference voltage generation circuit, comprising:

a first node that is connected to an output terminal;

a second node that is connected to a first current source;

a third node that is connected to a second current source;

a fourth node;

a first Darlington pair that has a first bipolar junction transistor with a base that is connected to the first node and a third bipolar junction transistor that is provided with an emitter-collector path that is connected between the second node and the fourth node and amplifies an output current of the first bipolar junction transistor;

a second Darlington pair that has a second bipolar junction transistor with a base that is connected to the first node and a fourth bipolar junction transistor that is provided with an emitter-collector path that is connected between the third node and the fourth node and amplifies an output current of the second bipolar junction transistor;

a first resistor that composes the first current source;

a second resistor that composes the second current source;

a third resistor with one end that is connected to an emitter of the second bipolar junction transistor and another end that is connected to a base of the fourth bipolar junction transistor; and a fourth resistor with one end that is connected to the fourth node and another end that is grounded; and a differential amplifier circuit that supplies an output signal that is dependent on a difference between voltage drops that are caused at the first resistor and the second resistor to the first node.

12. The bandgap type reference voltage generation circuit according to claim 11, wherein resistance values of the first resistor and the second resistor are set to be identical values.

13. The bandgap type reference voltage generation circuit according to claim 11, wherein emitter areas of the second and fourth bipolar junction transistors are set to be N times as large as emitter areas of the first and third bipolar junction transistors, where (N is any positive number of 1 or greater.

14. A bandgap type reference voltage generation circuit, comprising:

a first node that is connected to an output terminal;

a second node that is connected to a first current source;

a third node that is connected to a second current source;

a fourth node;

a first inverted Darlington pair that has a first bipolar junction transistor with a base that is connected to the first node and a third bipolar junction transistor that is provided with an emitter-collector path that is connected between the second node and the fourth node and amplifies an output current of the first bipolar junction transistor;

a second inverted Darlington pair that has a second bipolar junction transistor with a base that is connected to the first node and a fourth bipolar junction transistor that is provided with an emitter-collector path that is connected between the third node and the fourth node and amplifies an output current of the second bipolar junction transistor;

a first resistor that composes the first current source;

a second resistor that composes the second current source; and a differential amplifier circuit that supplies an output signal that is dependent on a difference between voltage drops that are caused at the first resistor and the second resistor to the first node.

15. The bandgap type reference voltage generation circuit according to claim 14, wherein resistance values of the first resistor and the second resistor are set to be identical values.

16. The bandgap type reference voltage generation circuit according to claim 14, wherein emitter areas of the second and fourth bipolar junction transistors are set to be N times as large as emitter areas of the first and third bipolar junction transistors, where (N is any positive number of 1 or greater.

17. The bandgap type reference voltage generation circuit according to claim 16, further comprising:

a third resistor that is connected between an emitter of the second bipolar junction transistor and the fourth node; and a fourth resistor with one end that is connected to the fourth node and the other end that is grounded.

* * * * *